US006302775B1

(12) United States Patent
Lee et al.

(10) Patent No.: US 6,302,775 B1
(45) Date of Patent: Oct. 16, 2001

(54) APPARATUS AND METHOD FOR COLD CROSS-SECTIONING OF SOFT MATERIALS

(75) Inventors: Russell Thomas Lee, Phoenix; William H. Lytle, Tempe, both of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/532,570

(22) Filed: Mar. 22, 2000

(51) Int. Cl.[7] ..... B24D 9/10
(52) U.S. Cl. ..... 451/494; 451/490
(58) Field of Search ..... 451/28, 41, 56, 451/285, 259, 268, 269, 490, 494, 540, 548

(56) References Cited

U.S. PATENT DOCUMENTS 5,921,852 * 7/1999 Kimura et al. ..... 451/494
6,116,998 * 9/2000 Damgaard et al. ..... 451/494
6,224,474 * 5/2001 Vander Voort ..... 451/494

* cited by examiner

*Primary Examiner*—Derris H. Banks
(74) *Attorney, Agent, or Firm*—Patricia S. Goddard

(57) ABSTRACT

Apparatus and a method of cold cross-sectioning soft materials includes providing a chuck attached to a drive motor with a composite plate attached to the chuck and including a heat insulating portion, a heat conducting layer, and a central axially extending duct with a plurality of radially extending conduits in communication therewith, the central axially extending duct is accessible externally for introducing a cooling liquid thereto. A sheet of grinding material is magnetically attached to the composite plate and the drive motor is activated to rotate the composite plate and grinding material. A cooling liquid is introduced into the duct and communicated to the conduits and a lubricant is supplied to the exposed rotating surface of grinding material.

47 Claims, 1 Drawing Sheet

APPARATUS AND METHOD FOR COLD CROSS-SECTIONING OF SOFT MATERIALS

FIELD OF THE INVENTION

This invention relates to apparatus and method for obtaining a cross-section of soft materials using a cold grinding process.

BACKGROUND OF THE INVENTION

Standard metallographic procedures are normally practiced at room temperature on relatively hard materials such as steel, refractory materials, even aluminum, and typically the samples are of such dimensions that there is little concern about destroying a sample by over polishing. Failure analysis or characterization of electronic materials especially very soft solders and some polymers presents unique challenges. Soft materials are removed rapidly during grinding making it difficult to control end point especially if the area of interest is very small. Soft materials often deform or smear, rendering it impossible to delineate interfaces and boundaries. Chips of harder materials surrounding the soft material or the grinding material itself often become embedded and cannot be removed. Lowering the temperature of the samples to be ground usually hardens the material allowing more controlled grinding and also reduces deformation. Cold polishing techniques are well known for these purposes but tend to be used for specific purposes and on a small scale.

Accordingly it is highly desirable to provide apparatus and a method of overcoming these problems.

BRIEF DESCRIPTION OF THE DRAWINGS

Referring to the drawings.

DESCRIPTION OF THE PREFERRED EMBODIMENT

Figure 1:
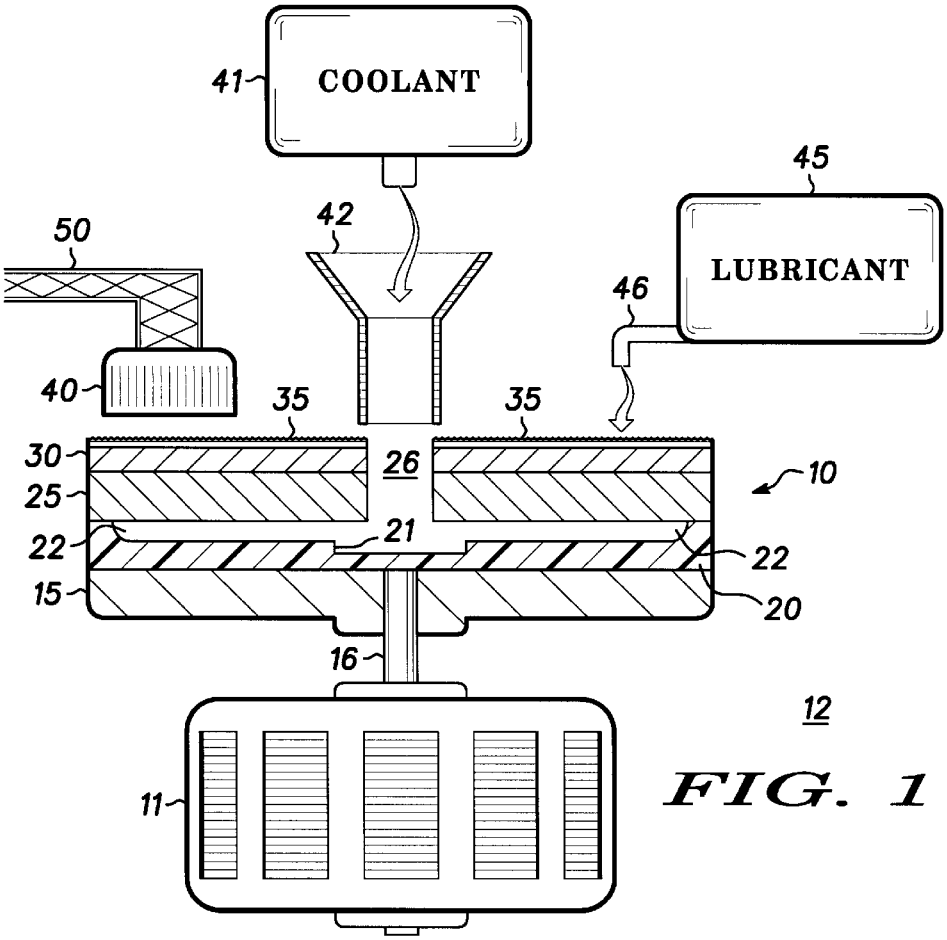
FIG. 1 is a simplified sectional view of a composite plate attached to a motor in cold cross-sectioning apparatus in accordance with the present invention.

Turning now to FIG. 1, a simplified sectional view of a composite plate or platen, generally designated 10, attached to a motor 11 in cold cross-sectioning apparatus 12 in accordance with the present invention. Plate 10 includes a chuck 15 fixedly attached to shaft 16 of motor 11 for rotation therewith. While chuck 15 is illustrated as a circular disk for convenience, it will be understood that any apparatus for attaching plate 10 to motor 11 for rotation is acceptable. Further, as will be understood after a careful study of the following disclosure, the various components of plate 10 may be constructed sufficiently large or thick, individually or as an assembly, so that chuck 15 is incorporated directly into plate 10 and a separate chuck, or other mounting structure is not required.

Figure 2:
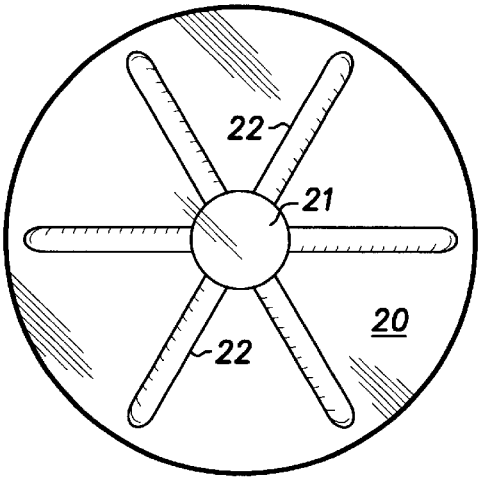
FIG. 2 is a top plan view of a temperature insulating layer of the composite plate of FIG. 1.

Composite plate 10 includes a heat insulating portion 20 positioned adjacent chuck 15. In this specific embodiment, heat insulating portion 20 is a circular heat insulating layer of hard plastic, such as polypropylene or the like. Referring additionally to FIG. 2, portion 20 includes a central axially extending duct 21 with a plurality of radially extending conduits 22 in communication therewith. Each of the conduits 22 terminates adjacent the outer periphery of portion 20 for reasons that will be explained in more detail presently. Further, while each of the conduits 22 is illustrated as extending straight along a radius of portion 20 from duct 21 to adjacent the outer periphery, it should be understood that other configurations, such as arcuate, helical, etc., could be used and such configurations would still come within the definition of radially extending conduits.

In the specific embodiment illustrated, portion 20 is formed of a plastic and conduits 22 are defined by grooves formed in the upper surface of portion 20. In another embodiment, conduits 22 are defined by copper tubes positioned in grooves formed in the upper surface of portion 20. The copper tubes aid in distributing temperatures equally across the entire area of plate 10 and form a more rugged coolant distribution system. While conduits 22 could be formed in other potions of plate 10, by forming conduits 22 in plastic portion 20, grooves can be conveniently formed by molding, grinding, etc. Also. portion 20 is formed of heat or temperature insulating material and placed adjacent chuck 15 and/or motor 11 to insulate motor 11 from the remainder of plate 10, as will be understood from the description to follow.

Figure 3:
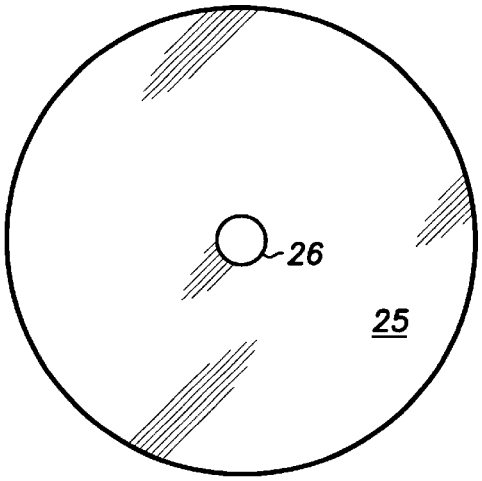
FIG. 3 is a top plan view of a temperature conducting layer of the composite plate of FIG. 1.

A heat or temperature conductive portion 25 is coaxially affixed to portion 20 so that the lower surface of portion 25 closes the grooves in portion 20 to form complete conduits 22 or contacts the copper tubes, if included. Also a central opening 26 is formed in disk 25 so as to be in communication with duct 21 in portion 20 and, thus, in communication with conduits 22. In this preferred embodiment, temperature conductive portion 25 is an aluminum disk as illustrated in FIG. 3, which is fixedly attached to portion 20 by screws, etc. Temperature conductive portion 25, which is in direct communication with conduits 22 conducts heat across the entire area of plate 10.

A magnetic portion 30 is attached to temperature conductive portion 25 opposite heat insulating portion 20. In this preferred embodiment, magnetic portion 30 is a magnetic disk, such as the commercially available rubberized magnetic sheets. It will of course be understood that magnetic portion 30 could be incorporated into temperature conductive portion 25 as an integral part thereof or as individual magnets embedded in the upper surface. However, for convenience in fabricating magnetic portion 30 of plate 10 a rubberized magnetic sheet can be most easily cut into a disk with a central opening in communication with duct 21. The magnetic disk is then fixedly attached to the upper surface of temperature conductive portion 25 by an adhesive or the like.

A grinding plate 35 is formed by coaxially attaching a disk of grinding paper to a disk of magnetic material, such as steel or the like. Generally, the grinding paper is permanently attached to the magnetic material by an adhesive or the like. A central opening is provided through grinding plate 35 in communication with duct 21 to provide external access to duct 21. Grinding plate 35 is then magnetically attached to magnetic portion 30 with the grinding surface directed upwardly to provide an exposed rotatable surface of grinding material. As the grinding surface (i.e. the grinding paper) wears or when different degrees of roughness are desired, grinding plate 35 can be easily changed and replaced with new or different grinding surfaces. It should also be noted that grinding plate 35 can be quickly and easily changed without altering the temperature of plate 10.

With all of the components of plate 10 in place as described, a sample of soft material to be cold crosssectioned is mounted in a holder 40 adjacent to the exposed rotatable surface of grinding material, i.e. the upper surface of grinding plate 35. A cooling liquid is introduced into duct 21, in this embodiment from a reservoir 41 by way of a funnel 42 positioned over the central opening in grinding plate 35. Funnel 42 can be simply suspend above plate 10 by some convenient structure or it can be threadedly engaged in the central opening through grinding plate 35, magnetic portion 30, and temperature conductive portion 25. In this preferred embodiment, the cooling liquid is liquid nitrogen which is introduced to duct 21 at approximately −196° C. As plate 10 is rotated by motor 11, the cooling liquid is forced outwardly in conduits 22 by centrifugal force so that the entire area of plate 10 is cooled. As the cooling liquid evaporates, nitrogen gas escapes back out of conduits 22 by way of duct 21, rather than being directed outwardly where it might harm an operator.

A lubricant, contained in a reservoir 45 is introduced to the grinding surface by way of a pipe 46. While a large variety of lubricants are presently available, in this specific embodiment propylene glycol is used because it remains liquid at low temperatures, but unlike most petroleum based lubricants it is non-toxic and can also be used with most plastics with out damage since it is non-corrosive to most plastics and metals. Since propylene glycol is also water soluble and is considered non-hazardous, it can be discharged down an industrial drain, unlike other typical low temperature lubricants based on more toxic petroleum distillates, such as kerosene.

Here it should be noted that sample holder 40 can be a commercially available fixture, such as a weighted fixture available from Technology Associated Inc. These individual weighted fixtures are not fixed and can be placed or distributed over the entire exposed surface of grinding plate 35 using simple guides 50 to constrain the movement. In this fashion up to eight samples can be polished simultaneously, whereas current polishers are capable of polishing only one sample at a time.

Thus, a new and improved platen and associated apparatus for use in the cold cross-sectioning of soft materials is disclosed. The new apparatus includes a magnetically attached grinding surface for quick change without requiring the temperature of the apparatus to be changed. The apparatus uses a cooling liquid, such as liquid nitrogen, which provides a much lower grinding temperature than was previously achievable. Also, the liquid coolant system is less expensive than the chillers and heat exchangers used in prior art equipment. An environmentally friendly lubricant, such as propylene glycol, is used in the grinding process. Also, because the grinding surface rotates, a plurality of samples can be polished simultaneously and different (e.g. smaller) sample sizes can be used to provide faster polish times. Because of the very high cooling available in the new apparatus, interfacial and microstructural characterization is possible for very soft materials, such as solder, indium bearing material, compliant films, etc. and for multicomponent structures, such as soft materials sandwiched between harder materials. Also, the time required for polishing is dramatically reduced so that failure analysis and characterization of soft materials is speed up along with the development of new materials.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A platen for use in the cold cross-sectioning of soft materials comprising:

a composite plate attached to a drive motor for rotation, the composite plate including a heat insulating portion, a heat conducting layer attached to the heat insulating portion, and a central axially extending duct with a plurality of radially extending conduits in communication therewith, the central axially extending duct being accessible externally for introducing a cooling liquid thereto; and a sheet of grinding material removably attached to an outer surface of the composite plate adjacent the heat conducting layer to provide an exposed rotatable surface of grinding material.

2. A platen for use in the cold cross-sectioning of soft materials as claimed in claim 1 wherein the sheet of grinding material is removably attached to the outer surface of the composite plate by means of magnetic material and a magnetic portion each mounted in a different one of the sheet of grinding material and the composite plate.

3. A platen for use in the cold cross-sectioning of soft materials as claimed in claim 2 wherein the magnetic portion includes a circular magnetic layer of rubberized magnetic sheet material.

4. A platen for use in the cold cross-sectioning of soft materials as claimed in claim 2 wherein the sheet of magnetic material includes a steel plate.

5. A platen for use in the cold cross-sectioning of soft materials as claimed in claim 1 wherein the heat insulating portion includes a circular heat insulating layer of hard plastic.

6. A platen for use in the cold cross-sectioning of soft materials as claimed in claim 5 wherein the hard plastic includes polypropylene.

7. A platen for use in the cold cross-sectioning of soft materials as claimed in claim 1 wherein the heat conducting layer includes a circular layer of aluminum.

8. A platen for use in the cold cross-sectioning of soft materials as claimed in claim 1 wherein the central axially extending duct and the plurality of radially extending conduits are defined by copper tubing.

9. A platen for use in the cold cross-sectioning of soft materials as claimed in claim 8 wherein the copper tubing is positioned in the heat insulating portion.

10. A platen for use in the cold cross-sectioning of soft materials as claimed in claim 1 including in addition an external reservoir of cooling liquid in communication with the central axially extending duct.

11. A platen for use in the cold cross-sectioning of soft materials as claimed in claim 10 wherein the external reservoir of cooling liquid includes a reservoir of liquid nitrogen.

12. A platen for use in the cold cross-sectioning of soft materials as claimed in claim 1 including in addition a reservoir of lubricant positioned to distribute the lubricant onto the exposed rotatable surface of grinding material.

13. A platen for use in the cold cross-sectioning of soft materials as claimed in claim 12 wherein the reservoir of lubricant includes a reservoir of propylene glycol.

14. A platen for use in the cold cross-sectioning of soft materials comprising:

a chuck attachable to a drive motor for rotation;

a composite plate attached to the chuck for rotation with the chuck, the composite plate including a heat insulating portion positioned adjacent the chuck, a heat conducting layer attached to the heat insulating portion opposite the chuck, a magnetic portion attached to the heat conducting layer opposite the heat insulating portion, and a central axially extending duct with a plurality of radially extending conduits in communication therewith, the central axially extending duct being accessible externally for introducing a cooling liquid thereto; and a grinding plate magnetically attached coaxially to the composite plate, the grinding plate including a sheet of magnetic material with a sheet of grinding material adhesively attached to an outer surface thereof to provide an exposed rotatable surface of grinding material, and affixed to the composite plate by interaction of the sheet of magnetic material and the magnetic portion.

15. A platen for use in the cold cross-sectioning of soft materials as claimed in claim 14 wherein the heat insulating portion includes a circular heat insulating layer of hard plastic.

16. A platen for use in the cold cross-sectioning of soft materials as claimed in claim 15 wherein the hard plastic includes polypropylene.

17. A platen for use in the cold cross-sectioning of soft materials as claimed in claim 14 wherein the heat conducting layer includes a circular layer of aluminum.

18. A platen for use in the cold cross-sectioning of soft materials as claimed in claim 14 wherein the central axially extending duct and the plurality of radially extending conduits are defined by copper tubing.

19. A platen for use in the cold cross-sectioning of soft materials as claimed in claim 18 wherein the copper tubing is positioned in the heat insulating portion.

20. A platen for use in the cold cross-sectioning of soft materials as claimed in claim 14 wherein the magnetic portion includes a circular magnetic layer of rubberized magnetic sheet material.

21. A platen for use in the cold cross-sectioning of soft materials as claimed in claim 14 wherein the sheet of magnetic material includes a steel plate.

22. A platen for use in the cold cross-sectioning of soft materials as claimed in claim 14 including in addition an external reservoir of cooling liquid in communication with the central axially extending duct.

23. A platen for use in the cold cross-sectioning of soft materials as claimed in claim 22 wherein the external reservoir of cooling liquid includes a reservoir of liquid nitrogen.

24. A platen for use in the cold cross-sectioning of soft materials as claimed in claim 14 including in addition a reservoir of lubricant positioned to distribute the lubricant onto the exposed rotatable surface of grinding material.

25. A platen for use in the cold cross-sectioning of soft materials as claimed in claim 24 wherein the reservoir of lubricant includes a reservoir of propylene glycol.

26. A platen for use in the cold cross-sectioning of soft materials comprising:

a chuck attachable to a drive motor for rotation;

a circular composite plate attached to the chuck for rotation with the chuck, the composite plate including a circular heat insulating layer positioned adjacent the chuck and coaxially attached to the chuck, a circular heat conducting layer coaxially attached to the heat insulating layer opposite the chuck, a circular magnetic layer coaxially attached to the heat conducting layer opposite the heat insulating layer, and a central axially extending duct with a plurality of radially extending conduits in communication therewith, the central axially extending duct being accessible externally for introducing a cooling liquid thereto; and a grinding plate magnetically attached coaxially to the platen, the grinding plate including a sheet of magnetic material with a sheet of grinding material adhesively attached to an outer surface thereof to provide an exposed rotatable surface of grinding material.

27. A platen for use in the cold cross-sectioning of soft materials as claimed in claim 26 wherein the circular heat insulating layer includes a hard plastic.

28. A platen for use in the cold cross-sectioning of soft materials as claimed in claim 27 wherein the hard plastic includes polypropylene.

29. A platen for use in the cold cross-sectioning of soft materials as claimed in claim 26 wherein the circular heat conducting layer includes aluminum.

30. A platen for use in the cold cross-sectioning of soft materials as claimed in claim 26 wherein the central axially extending duct and the plurality of radially extending conduits are defined by copper tubing.

31. A platen for use in the cold cross-sectioning of soft materials as claimed in claim 30 wherein the copper tubing is positioned in the circular heat insulating layer.

32. A platen for use in the cold cross-sectioning of soft materials as claimed in claim 26 wherein the circular magnetic layer includes a rubberized magnetic sheet.

33. A platen for use in the cold cross-sectioning of soft materials as claimed in claim 26 wherein the sheet of magnetic material includes a steel plate.

34. A platen for use in the cold cross-sectioning of soft materials as claimed in claim 26 including in addition an external reservoir of cooling liquid in communication with the central axially extending duct.

35. A platen for use in the cold cross-sectioning of soft materials as claimed in claim 34 wherein the external reservoir of cooling liquid includes a reservoir of liquid nitrogen.

36. A platen for use in the cold cross-sectioning of soft materials as claimed in claim 26 including in addition a reservoir of lubricant positioned to distribute the lubricant onto the exposed rotatable surface of grinding material.

37. A platen for use in the cold cross-sectioning of soft materials as claimed in claim 36 wherein the reservoir of lubricant includes a reservoir of propylene glycol.

38. A method of cold cross-sectioning soft materials comprising the steps of:

providing a drive motor for rotation, a composite plate attached to the drive motor for rotation with the drive motor, the composite plate including a heat insulating portion, a heat conducting layer attached to the heat insulating portion, and a central axially extending duct with a plurality of radially extending conduits in communication therewith, the central axially extending duct being accessible externally for introducing a cooling liquid thereto;

removably attaching a sheet of grinding material to an outer surface of the composite plate adjacent the heat conducting layer to provide an exposed rotatable surface of grinding material;

activating the drive motor to rotate the composite plate and attached sheet of grinding material, introducing a cooling liquid to the central axially extending duct so that the cooling liquid is communicated to the plurality of radially extending conduits; and introducing a lubricant to the exposed rotating surface of grinding material.

39. A method of cold cross-sectioning soft materials as claimed in claim 38 wherein the step of providing the composite plate including the heat insulating portion includes providing a composite plate with a circular heat insulating layer of hard plastic.

40. A method of cold cross-sectioning soft materials as claimed in claim 39 wherein the hard plastic includes polypropylene.

41. A method of cold cross-sectioning soft materials as claimed in claim 38 wherein the step of providing the composite plate including the heat conducting layer includes providing a composite plate with a circular heat conducting layer of aluminum.

42. A method of cold cross-sectioning soft materials as claimed in claim 38 wherein the step of providing the composite plate including the central axially extending duct and the plurality of radially extending conduits includes the step of defining the central axially extending duct and the plurality of radially extending conduits with copper tubing.

43. A method of cold cross-sectioning soft materials as claimed in claim 42 wherein the step of defining the central axially extending duct and the plurality of radially extending conduits with copper tubing includes positioning the copper tubing in the heat insulating portion.

44. A method of cold cross-sectioning soft materials as claimed in claim 38 wherein the step of removably attaching the sheet of grinding material to the outer surface of the composite plate includes magnetically attaching the sheet of grinding material to the outer surface of the composite plate.

45. A method of cold cross-sectioning soft materials as claimed in claim 44 wherein the step of magnetically attaching the sheet of grinding material to the outer surface of the composite plate includes providing magnetic material and a magnetic portion and mounting each in a different one of the sheet of grinding material and the composite plate.

46. A method of cold cross-sectioning soft materials as claimed in claim 38 wherein the step of introducing the cooling liquid to the central axially extending duct includes providing a reservoir of liquid nitrogen in communication with the central axially extending duct.

47. A method of cold cross-sectioning soft materials as claimed in claim 38 wherein the step of introducing a lubricant to the exposed rotating surface of grinding material includes providing a reservoir of propylene glycol in communication with the exposed rotating surface of grinding material.

* * * * *